US009900691B2

(12) United States Patent
Marcone et al.

(10) Patent No.: US 9,900,691 B2
(45) Date of Patent: Feb. 20, 2018

(54) METHOD AND CIRCUITRY FOR PROTECTING AN ELECTROMECHANICAL SYSTEM

(71) Applicant: Marvell World Trade Ltd., St. Michael (BB)

(72) Inventors: Bruno Marcone, Pavia (IT); Giuseppe Santillo, Pavia (IT); Alberto Ressia, Alessandria (IT); Giuseppe Alfieri, Pavia (IT)

(73) Assignee: Marvell World Trade Ltd., St. Michael (BB)

( * ) Notice: Subject to any disclaimer, the term of this patent is extended or adjusted under 35 U.S.C. 154(b) by 152 days.

(21) Appl. No.: 15/005,323

(22) Filed: Jan. 25, 2016

(65) Prior Publication Data

US 2016/0309255 A1 Oct. 20, 2016

Related U.S. Application Data

(60) Provisional application No. 62/147,282, filed on Apr. 14, 2015.

(51) Int. Cl.
*H04R 3/00* (2006.01)

(52) U.S. Cl.
CPC ..... *H04R 3/007* (2013.01)

(58) Field of Classification Search
CPC ..... H04R 3/007
See application file for complete search history.

(56) References Cited

U.S. PATENT DOCUMENTS 9,014,380 B2 * 4/2015 Gautama ..... H04R 3/002 330/145
2009/0047005 A1 * 2/2009 Liao ..... H02K 11/33 388/811
2009/0304202 A1 * 12/2009 Somasundaram ... H04R 29/007 381/82
2015/0304772 A1 * 10/2015 Risberg ..... H04R 3/007 381/55

OTHER PUBLICATIONS

Klippel, W., "Prediction of Speaker Performance at High Amplitudes," *Audio Engineering Society, Convention Paper* 5418, Presented at the 111th Convention of the Audio Engineering Society, pp. 1-14, Sep. 21-24, 2001.

* cited by examiner

*Primary Examiner* — Muhammad N Edun

(57) ABSTRACT

To limit motion in an electromechanical system, an input signal is filtered using an adaptive filter, such as an infinite impulse response filter, to yield a predicted motion, and the input signal is attenuated by an amount controlled by the predicted motion. The filtering may further yield a predicted temperature, and the amount of attenuating may be further controlled by that temperature. Components of the input signal at selected frequencies may be removed, and a portion of the input signal from which the components have been removed may be mixed with a portion of the input signal from which components have not been removed. The removing of components at selected frequencies may include applying a notch filter, and the two portions may be equalized. phase-adjusting the unfiltered portion to account for phase delay introduced by the notch filter. The notch filter may operate at a resonant frequency of the system.

21 Claims, 4 Drawing Sheets

METHOD AND CIRCUITRY FOR PROTECTING AN ELECTROMECHANICAL SYSTEM

CROSS REFERENCE TO RELATED APPLICATION

This claims the benefit of commonly-assigned U.S. Provisional Patent Application No. 62/147,282, filed Apr. 14, 2015, which is hereby incorporated by reference herein in its entirety.

FIELD OF USE

Implementations of the subject matter of this disclosure generally pertain to apparatus and methods for protecting electromechanical systems from damage caused by being overdriven. In particular, implementations of the subject matter of this disclosure pertain to apparatus and methods for protecting speakers.

BACKGROUND

The background description provided herein is for the purpose of generally presenting the context of the disclosure. Work of the inventors hereof, to the extent the work is described in this background section, as well as aspects of the description that may not otherwise qualify as prior art at the time of filing, are neither expressly nor impliedly admitted to be prior art against the present disclosure.

Certain kinds of electromechanical systems are susceptible to damage if overdriven. For example, a loudspeaker may be damaged if overdriving causes the speaker membrane or cone, or the voice coil itself, to move beyond its designed excursion limit. Another source of potential damage to a loudspeaker may arise from high temperatures, which might result from ohmic heating. Such temperatures could cause adhesives used in the loudspeaker to melt, and could also cause the speaker membrane or cone to become brittle and ultimately fail.

As another example, an electric motor may be damaged if overdriving causes the motor to exceed its designed rotational speed limit. Similarly, stress resulting from frequent substantial speed changes could cause mechanical failure (e.g., of motor bearings).

Known techniques for controlling overdriving of electromechanical systems are either mechanically complex (which also results in greater cost), or computationally complex.

SUMMARY

A method, according to implementations of the subject matter of this disclosure, for limiting motion in an electromechanical system, includes filtering an input signal using an adaptive filter to yield a predicted motion, and attenuating the input signal by an amount controlled by the predicted motion.

The filtering may be performed using an adaptive infinite impulse response filter.

The filtering may further yield a predicted temperature, and the amount of attenuating may be further controlled by the predicted temperature. The attenuating may include clamping the input signal at a predetermined amplitude when the predicted temperature exceeds a threshold.

The electromechanical system may be a loudspeaker, in which case the motion may be displacement of a transducer of the loudspeaker, and the attenuating may include removing components of the input signal at selected frequencies. The attenuating may includes mixing a portion of the input signal from which the components have been removed with a portion of the input signal from which the components have not been removed. The mixing may be performed according to a combination of more than one mixing function.

The method may further include equalizing the portion of the input signal from which the components have not been removed with the portion of the input signal from which the components have been removed. The removing of components of the input signal at selected frequencies may include applying a notch filter, and the equalizing may include phase-adjusting the portion of the input signal from which the components have not been removed to account for phase delay introduced by the notch filter. Removing components of the input signal at selected frequencies may include applying a notch filter. The notch filter may operate at a resonant frequency of the loudspeaker.

The electromechanical system may be a motor, and the motion may be the rotational speed of the motor.

Circuitry, according to implementations of the subject matter of this disclosure, for limiting motion in an electromechanical system, may include an adaptive filter to yield a predicted motion from an input signal, control circuitry to attenuate the input signal by an amount controlled by the predicted motion. The adaptive filter may be an adaptive infinite impulse response filter.

The adaptive filter may further yield a predicted temperature, and the control circuitry may further attenuate the input signal based on the predicted temperature. The control circuitry may include a clamping circuit to clamp the input signal at a predetermined amplitude when the predicted temperature exceeds a threshold.

The electromechanical system may be a loudspeaker, in which case the motion may be displacement of a transducer of the loudspeaker, and the control circuitry may include a notch filter to remove components of the loudspeaker input signal at selected frequencies. The selected frequencies may be centered on a resonant frequency of the loudspeaker. The control circuitry may include a mixer to mix a portion of the input signal that passes through the notch filter with a portion of the input signal that does not pass through the notch filter. The mixer may operate according to a combination of more than one mixing function.

Circuitry according to implementations of the subject matter of this disclosure may further include a path equalizer to phase-adjust the portion of the input signal that does not pass through the notch filter to match phase delay introduced by the notch filter.

The electromechanical system may be a motor, in which case the motion may be the rotational speed of the motor.

BRIEF DESCRIPTION OF THE DRAWINGS

Further features of the disclosure, its nature and various advantages, will be apparent upon consideration of the following detailed description, taken in conjunction with the accompanying drawings, in which like reference characters refer to like parts throughout, and in which.

DETAILED DESCRIPTION

As noted above, electromechanical systems such as loudspeakers and electric motors are susceptible to damage by overdriving. Implementations of the subject matter of this disclosure may be used to control the driving signals of an electromechanical system to minimize such damage. Although the subject matter of this disclosure may be useful for different types of electromechanical systems, the description which follows will focus, for ease of discussion, on loudspeakers. However, that focus is not meant to limit the scope of this disclosure.

Figure 1:
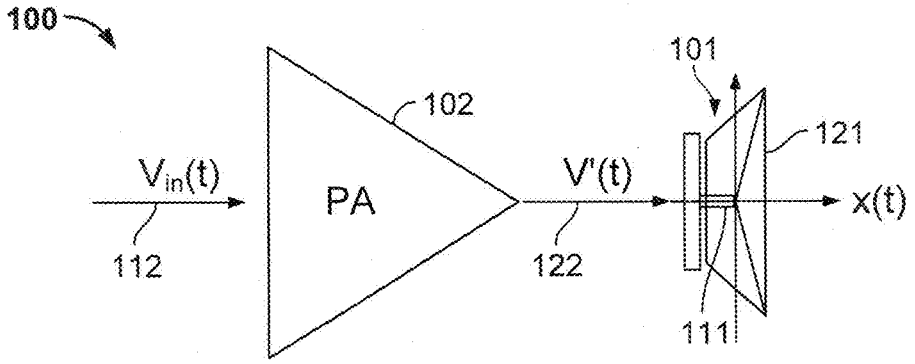
FIG. 1 shows a simplified representation of a loudspeaker system with which implementations of the subject matter of this disclosure may be used.

A simplified representation of a loudspeaker system 100 is shown in FIG. 1. Loudspeaker 101 includes a transducer such as a voice coil 111 and a membrane/cone 121, and is driven by an amplified signal 122 from amplifier circuitry 102, based on an input signal 112. Input signal 112 is indicated as a time-varying voltage $V_{in}(t)$, but also may be characterized as a time-varying current (not shown). Under the control of amplified signal 122, voice coil 111 causes membrane/cone 121 to vibrate, reproducing sound. The vibrations may be characterized as a time-varying physical displacement x(t), which can occur in both directions from a resting position.

Figure 2:
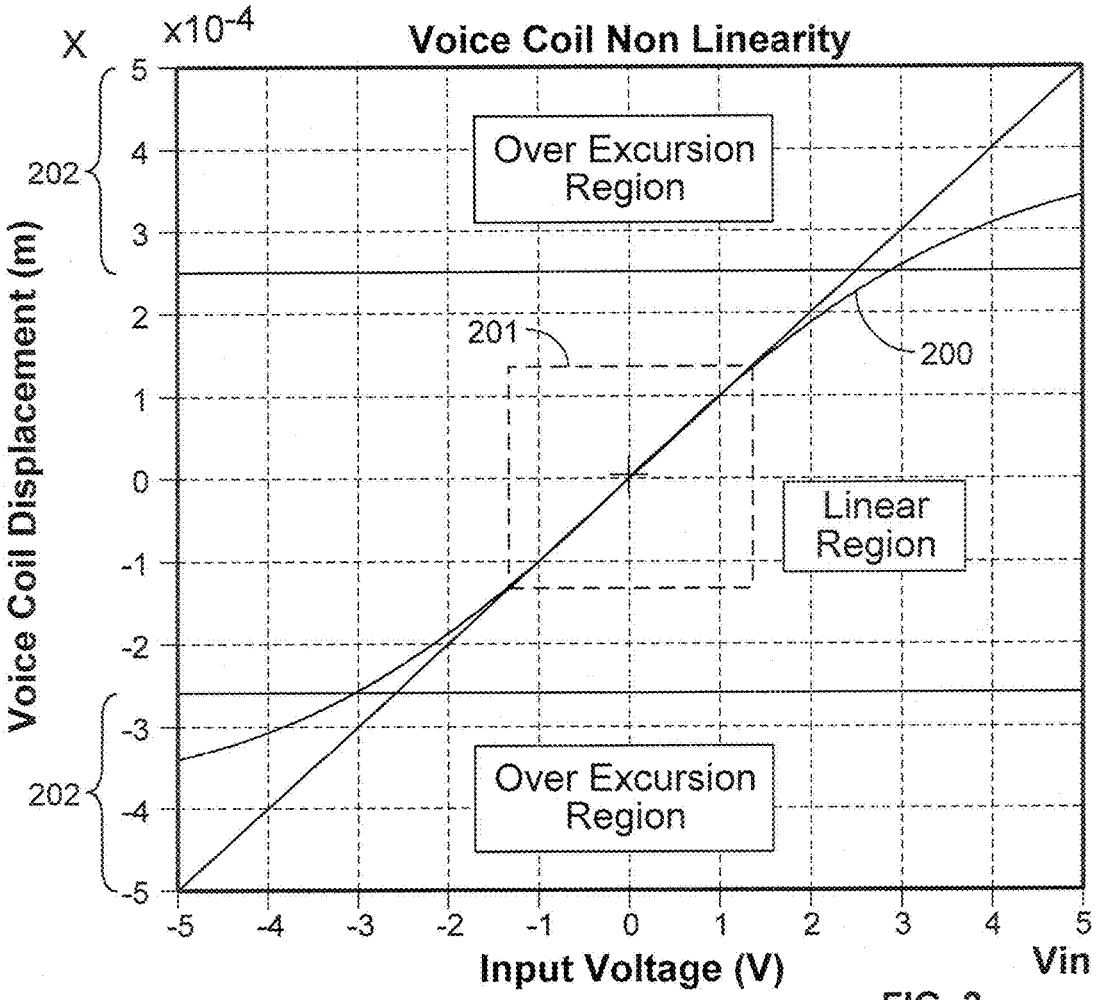
FIG. 2 is a graphical representation of voice coil displacement as a function of input voltage for a representative loudspeaker.

If the displacement is too great (resulting from the loudspeaker being overdriven), which is sometimes referred to as "over-excursion," the displacement can actually cause physical damage to components of the loudspeaker. This is shown in FIG. 2, which shows positive and negative voice coil displacement x(t) as a function 200 of input voltage $V_{in}(t)$ for a representative loudspeaker. In region 201, at low input voltages, the relationship of displacement to voltage is approximately linear. As the absolute value of the voltage increases, the absolute value of displacement becomes non-linear and increases more slowly than the voltage. Loudspeaker damage begins to occur at a displacement that varies depending on parameters (including size) of the particular loudspeaker. For the example in FIG. 2, over-excursion regions 202 begin at a displacement of about ±0.25 mm from the resting position.

Known techniques for preventing damaging over-excursion of a loudspeaker suffer from various disadvantages. For example, in a first technique, the actual voice coil displacement is directly measured. Although this first technique provides an accurate measurement of the voice coil displacement, with low computational overhead, this first technique requires expensive and electromechanically complex hardware.

According to a second technique, the driving voltage and/or current are measured, and a linear model of the loudspeaker is used to determine the voice coil displacement corresponding to the measured voltage and/or current. This second technique does not require any special hardware, and has low computational overhead. However, as may be appreciated from the displacement function 200 represented in FIG. 2, above, this second technique produces inaccurate results that are at best an approximation of the actual voice coil displacement. Indeed, because damaging over-excursion occurs only outside the linear region 201 of loudspeaker operation, in the example of FIG. 2 this second technique will be least accurate precisely in the operating region in which it is needed. In fact, this technique will overestimate the voice coil displacement, and therefore unnecessarily reduce the loudspeaker output. The inaccuracy is compounded because voice coil displacement is frequency-dependent, being greatest at the resonant frequency of the loudspeaker, but because the actual loudspeaker system is non-linear, the resonant frequency itself changes with amplitude.

According to a third technique, the driving voltage and/or current are measured, and the voice coil displacement corresponding to the measured voltage and/or current is determined by a linear model of the loudspeaker that is augmented by a lumped parameter model (also known as a lumped component model or lumped element model) for the non-linear parameters. This third technique does not require any special hardware, and produces a relatively accurate result, but is computationally intensive, and therefore power-intensive as well.

Figure 3:
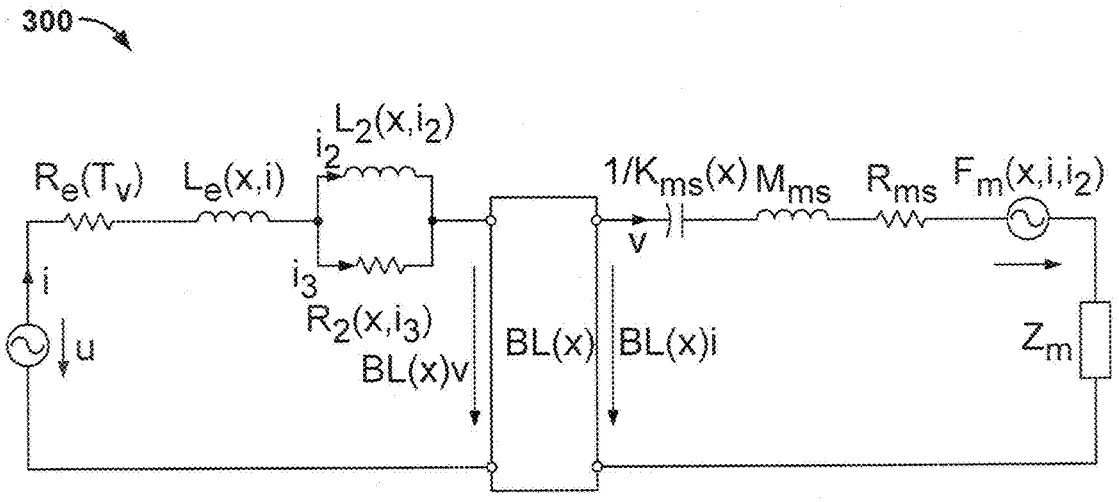
FIG. 3 is a representation of a lumped parameter model of a loudspeaker.

A lumped parameter model 300 of a loudspeaker, as described by W. Klippel, "Prediction of Speaker Performance at High Amplitudes", Convention Paper 5418, 111th Convention of the Audio Engineering Society (2001), is shown in FIG. 3, where:

$R_e$=electrical resistance $R_{ms}$=mechanical resistance
$L_e$=electrical inductance $F_m$=reluctance force
BL=force factor $Z_m$=lossy inductance
$R_2$, $L_2$=Eddy factor parameters $M_{ms}$=mechanical mass
$K_{ms}$=stiffness The lumped parameters may be derived computationally from the lumped parameter model, giving rise to the computational burden referred to above for this third technique.

In accordance with implementations of the subject matter of this disclosure, the computational burden of determining the lumped parameters may be reduced by using an adaptive filter to match the loudspeaker current. The filter coefficients resulting from that adaptation can be used to directly predict voice coil displacement as discussed below. The filter may be an infinite impulse response (IIR) filter, which responds quickly to input changes.

A subset of the lumped parameters may be identified as functions of the voice coil displacement x:

$R_e(x)$, $K_{ms}(x)$, $M_{ms}(x)$, $R_{ms}(x)$, BL (x)

which also may be referred to as $R_e$, $K_t$, $m_t$, $c_t$, and $\Phi$, respectively. These t parameters may be calculated directly from the IIR filter coefficients adaptation without knowing the displacement x. Therefore, instead of deriving these parameters from x, x can be derived from these parameters.

An adaptive IIR Filter is used to minimizing the error between the measured loudspeaker current and the estimated loudspeaker current. The IIR transfer function (in the z-transformed domain) is:

$$Y(z)=(b_0+b_1z^{-1}+b_2z^{-2})/(1+a_1z^{-1}+a_2z^{-2})$$

where the vector [b0 b1 b2 a1 a2] represents the adapted coefficients. During normal sound reproduction, the adapted coefficients "move" trough the solution space, in order to minimize the adaptive error, thereby adapting the internal filter to the external loudspeaker. After the adaptive filter coefficients have been adapted, they track loudspeaker variations in real time. Therefore, they can be used to predict the non-linear lumped parameters and the voice coil displacement.

Starting from the IIR Adapted Admittance:

$$Y(z)=(b_0+b_1z^{-1}+b_2z^{-2})/(1+a_1z^{-1}+a_2z^{-2}) \quad 1)$$

This can be rewritten in a more canonical form:

$$Y'(z)=(b_0z^2+b_1z+b_2)/(z^2+a_1z+a_2) \quad 2)$$

Applying the z2s Direct Transform (from the discrete-time z domain to the continuous-time Laplace s domain):

$$z=1+sT \quad 3)$$

gives the s-Admittance:

$$Y'(s)=(((b_0+b_1+b_2)/T^2)+((2b_0+b_1)s/T)+b_0s^2)/(((1+a_1+a_2)/T^2)+((2+a_1)s/T)+s^2) \quad 4)$$

Rewriting the s-Admittance using the lumped parameters and applying Eq. 3:

$$Y(s)=(k_t/R_{eb}m_t+c_ts/R_{eb}m_t+s^2/R_{eb})/(k_t/m_t+(c_t/m_t+\Phi^2/R_{eb}m_t)s+s^2) \quad 5)$$

from which the relationships between the lumped parameters and the z-Admittance coefficients may be determined:

$$R_{eb}=1/b_0 \quad 6)$$

$$k_t=m_t((1+a_1+a_2)/T^2) \quad 7)$$

$$c_t=(m_t/b_0)((2b_0+b_1)/T) \quad 8)$$

$$\Phi^2=(m_t/b_0)(2+a_1/T)-c_t/m_t) \quad 9)$$

Eq.9 can be rewritten as:

$$\Phi=(1/b_0)(m_t(a_1b_0-b_1)/T)^{0.5} \quad 10)$$

The resonant frequency $f_0$ also may be calculated from the z-Admittance $$f_0=(1/2\pi)(k_t/m_t)^{0.5}=(1/2\pi)((1+a_1+a_2)/T)^{0.5} \quad 11)$$

The voice coil displacement in the s-domain is:

$$X'(s)=(\Phi/R_{eb}m_t)/(k_t/m_t+(c_t/m_t+\Phi^2/R_{eb}m_t)s+s^2) \quad 12)$$

Substituting Eqs. 6-9 yields voice coil displacement in the z-domain in terms of the filter coefficients [b0 b1 b2 a1 a2]:

$$X(z)=(1/b_0)(m_t(a_1b_0-b_1)/T)^{0.5}z^{-2})/(1+a_1z^{-1}+a_2z^{-2}) \quad 13)$$

The estimated voice coil displacement can be obtained by applying the input voltage signal:

$$X_e(z)=X(z)V_{in}(z) \quad 14)$$

Estimated loudspeaker temperature also can be derived from the filter coefficients. The estimated loudspeaker temperature can be predicted from electrical resistance lumped parameter $R_e(T_0)$ $(T)=R_e(T_0)$ $(1+\alpha(T-T_0))$, where $\alpha=3.86\times 10^{-3}/°$ K for copper. This can be rewritten as $T=T_0+(1/\alpha)(((R_e(T))/(R_e(T_0))-1)$, where the $R_e$ terms may be derived from the filter coefficients as described above.

Figure 4:
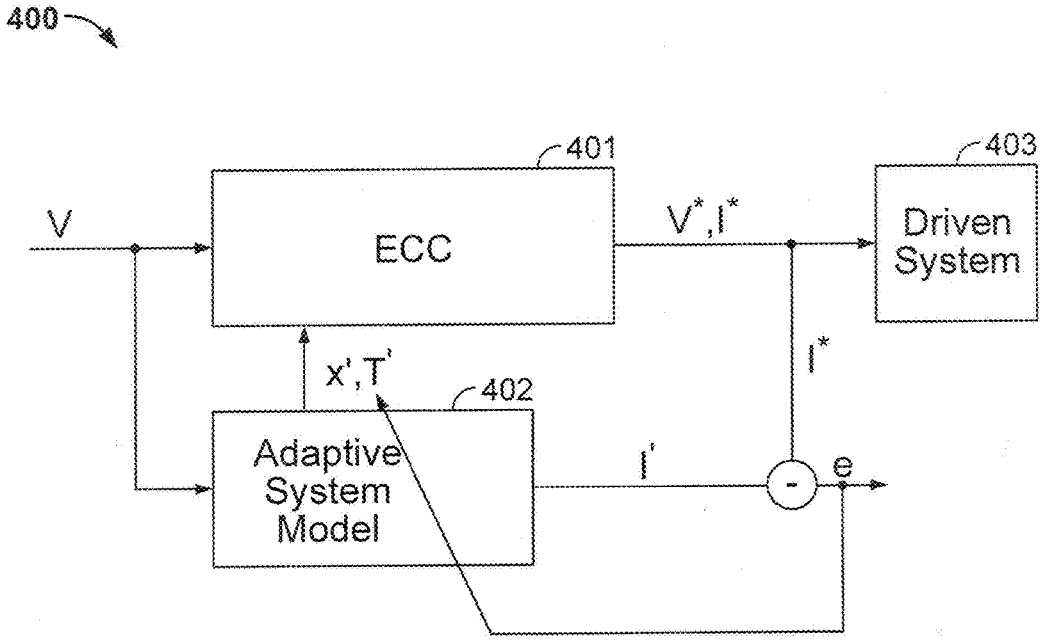
FIG. 4 is a schematic representation of an electromechanical protection system incorporating implementations of the subject matter of this disclosure.

An electromechanical protection system 400 based on motion estimated in this way is shown in FIG. 4, and includes an excursion compressor control (ECC) block 401 and an adaptive system model 402. The incoming voltage signal V is input to both ECC block 401 and adaptive speaker model 402. An adjusted voltage V* is output by ECC block 401 and drives electromechanical system 403, and also is fed back to adaptive system model 402. Adaptive system model 402 outputs a current I' based on input voltage V, and on error signal e, which results from subtracting I' from the adjusted current I* and which is fed back to adaptive system model 402. Adaptive system model 402 also outputs estimated motion x' and estimated temperature T', which are input to ECC block 401 to generate adjusted voltage V* and adjusted current I*.

Figure 5:
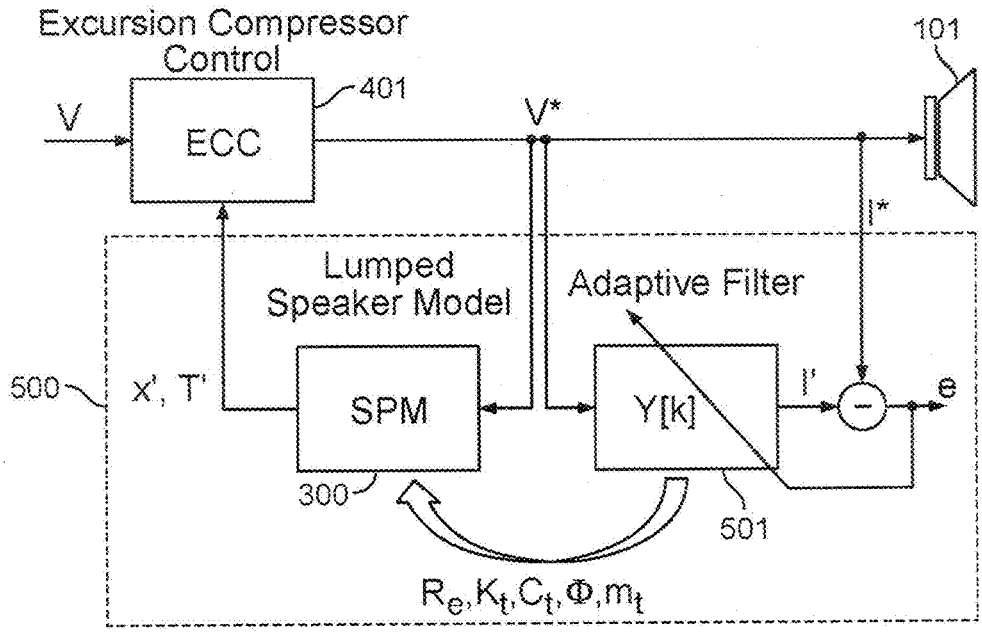
FIG. 5 is a schematic representation of a loudspeaker protection system incorporating implementations of the subject matter of this disclosure.

As discussed above, system 403 may be loudspeaker. Thus, adaptive system model 402 may be an adaptive speaker model, in which estimated motion x' is estimated voice coil displacement. As shown in FIG. 5, adaptive speaker model 500 may include lumped speaker model 300 and adaptive IIR filter 501, which operates as described above in connection with Equations 1-14. Adaptive IIR filter 501 receives, as inputs, error signal e and adjusted voltage V*, and provides the lumped parameters $R_e$, $K_t$, $M_t$, $c_t$, and $\Phi$, to lumped speaker model 300. Lumped speaker model 300 also receives, as inputs, input voltage V and adjusted voltage V*.

Figure 6:
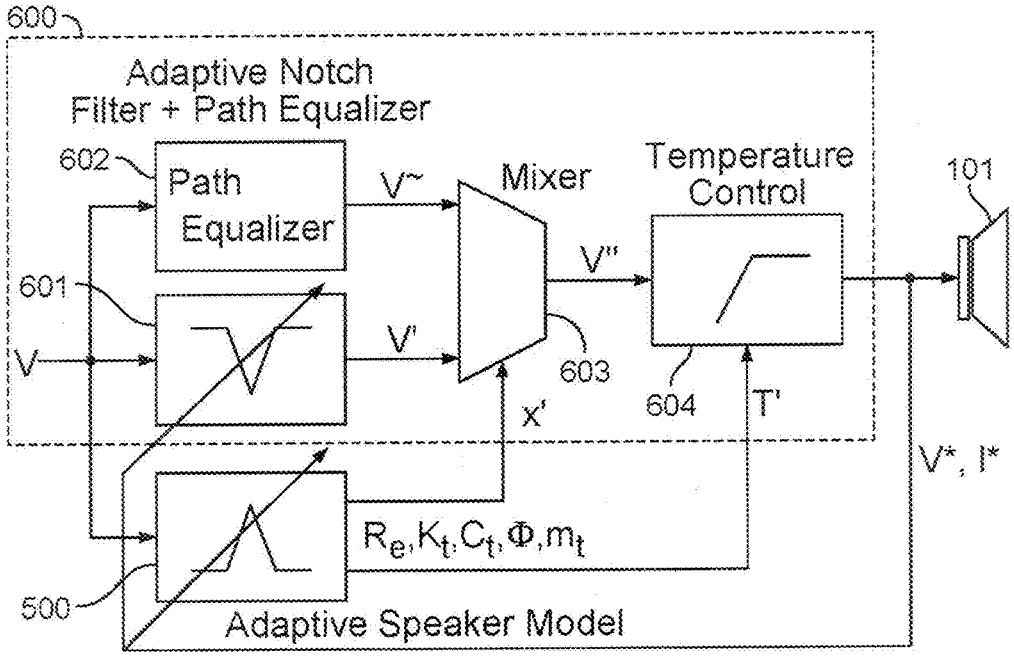
FIG. 6 is a schematic representation of a loudspeaker protection system such as that of FIG. 5, with some components shown in more detail than in FIG. 5, and some components shown in less detail than in FIG. 5.

In practice, as shown in FIG. 6, adaptive speaker model 500 is collapsed to a single block that provides estimated displacement x' and estimated temperature T' based on the IIR coefficients as described above, without explicitly deriving the parameters $R_e$, $K_t$, $m_t$, $c_t$, and $\Phi$.

FIG. 6 also shows an implementation 600 of ECC block 401 in more detail. As shown, implementation 600 of ECC block 401 includes an adaptive notch filter 601, a path equalizer 602, an attenuation control mixer 603, and a temperature control block 604.

Attenuation control mixer 603 selects equalized voltage V~ from path equalizer 602, or attenuated voltage V' from adaptive notch filter 601, or a mix of voltage V~ and voltage V', depending on the value of estimated displacement x' from adaptive speaker model 402. As noted above, voice coil displacement is greatest at the resonant frequency of loudspeaker 101, and the resonant frequency is amplitude dependent. If the estimated displacement is large enough to potentially damage loudspeaker 101, attenuation control mixer 603, under control of estimated displacement x', will select more of voltage V' from adaptive notch filter 601. Adaptive notch filter 601 will have adapted to the instantaneous resonant frequency based on the adjusted voltage V* and the adjusted current I*, reducing the amplitude of the input voltage component at the resonant frequency in voltage V'. Therefore, selection of voltage V' from adaptive notch filter 601 will reduce the voice coil displacement from damaging levels by removing from adjusted voltage V* the greatest contribution to those damaging levels.

On the other hand, if the estimated displacement is not large enough to potentially damage loudspeaker, attenuation control mixer 603, under control of estimated displacement x', will select more of voltage V~ from path equalizer 602. Path equalizer 602 does not affect the magnitude of voltage V~, but adjusts for any phase delay introduced by adaptive notch filter 601, so that there is no phase mismatch between the portion of the signal that passes through adaptive notch filter 601, and the portion of the signal that does not pass through adaptive notch filter 601.

In one implementation, attenuation control mixer 603 may be a mixed-mode attenuation control (MMAC) mixer, using a combination of frequency attenuation control (FAC) and amplitude attenuation control (AAC) to select the relative amounts of voltage V~ and voltage V' to pass.

Figure 7:
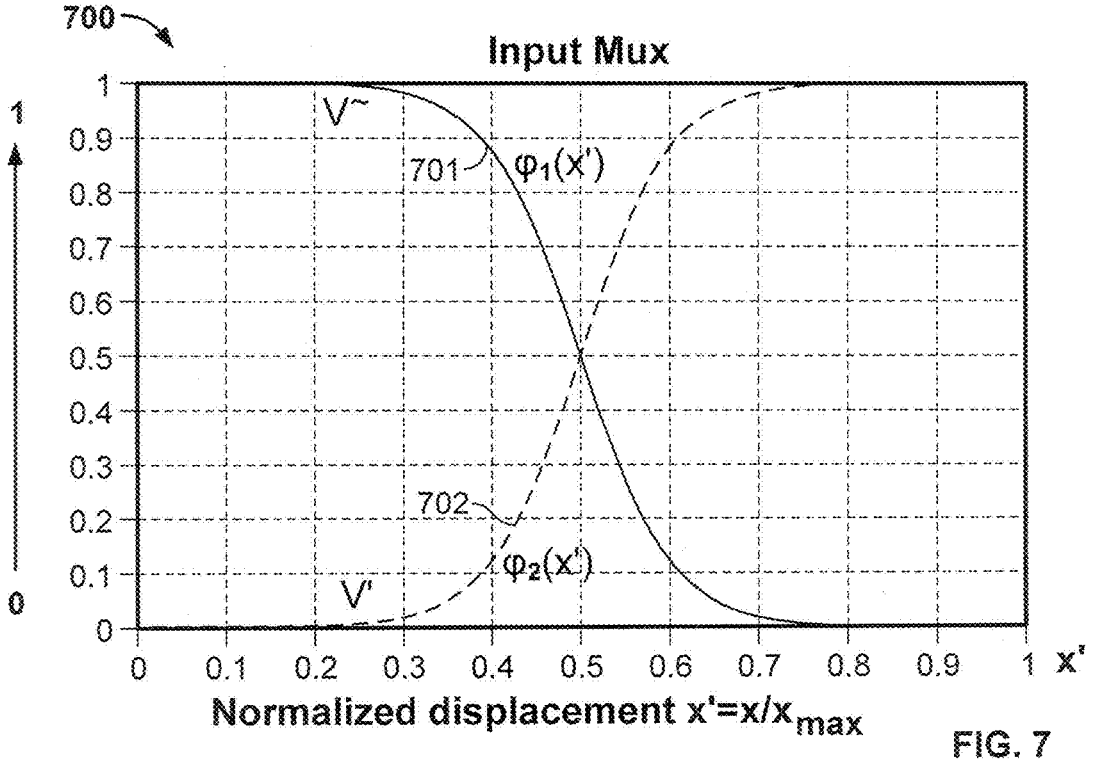
FIG. 7 shows an example of a frequency attenuation control transfer function that may be used in implementations of the subject matter of this disclosure.

FIG. 7 shows an example 700 of an FAC transfer function that may be used by MMAC mixer 603. The relative amounts of voltage V~ and voltage V' selected by MMAC mixer 603 are shown in FIG. 7 as a function of normalized estimated displacement $x'=x/x_{max}$. At a low level of displacement, the unfiltered, but phase-equalized, input signal ($V^{\sim}$) passes without attenuation while the notch-filtered signal (V') is blocked. At higher levels of displacement, more of the notch-filtered signal (V') is passed, and the output V" contains very little, or none, of the original signal from frequencies close to resonant frequency. FAC transfer function 700 may be described mathematically as the linear combination of a function 701 of input signal $V^{\sim}$, denominated $\phi_1(x')$, and a function 702 of notch-filtered signal V', denominated $\phi_2(x')$:

$$FAC=\phi_1(x')V^{\sim}+\phi_2(x')V'.$$

This results in relatively smooth control of voice coil displacement.

However, at a very high volume level, FAC transfer function 700 may not be sufficient to limit excessive voice coil displacement. Therefore, in addition to FAC transfer function 700, MMAC mixer 603 may also use an AAC transfer function such as the AAC transfer function 800 shown in FIG. 8 as $\phi_3(x')$. At a low level of displacement, AAC transfer function 800 does not attenuate the input signal. But as displacement increases, the input signal is attenuated by an increasing amount, limiting voltage V" and therefore the voice coil displacement. The overall transfer function of MMAC 603 in this example is therefore:

$$V''=\phi_3(x')[(\phi_1(x')V^{\sim}+\phi_2(x')V'].$$

Temperature control block 604 receives the estimated or predicted temperature T' from adaptive speaker model 402 and the voltage V", and adjusts the voltage V" to yield voltage V*. One example of a temperature control transfer function 614 is shown in block 604, where the output voltage V* is clamped at a certain maximum voltage, which transfer function 614 reaches at a certain maximum temperature $T_{max}$, which may be predetermined according to the temperature at which the speaker (or other system) may be damaged.

Figure 8:
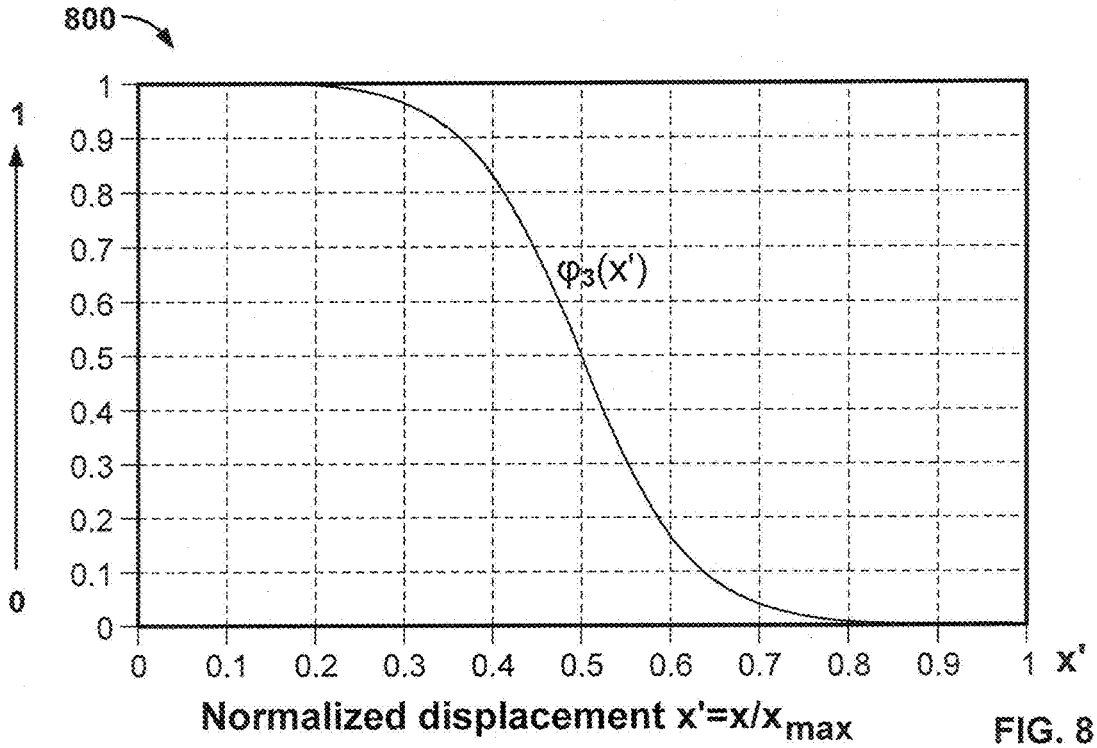
FIG. 8 shows an example of an amplitude attenuation control transfer function that may be used in implementations of the subject matter of this disclosure.

Thus it is seen that without complex hardware for measuring actual voice coil displacement, and without a high computational burden, a loudspeaker protection method and system according to implementations of the subject matter of this disclosure will pass through loudspeaker input signals causing low levels of voice coil displacement, but for loudspeaker input signals causing higher levels of voice coil displacement, the signal will be attenuated by increasing amounts as voice coil displacement approaches a loudspeaker damage threshold, based on transfer functions such as those illustrated in FIGS. 7 and 8. Similarly, loudspeaker input signals that may cause a small temperature increase would be allowed to pass, while loudspeaker input signals that may cause potentially damaging temperature increase would be clamped at a non-damaging level according to a transfer function such that illustrated in FIG. 6.

The systems and methods described above can be used in any fixed or portable system that includes a loudspeaker for reproducing audio signals, such as a mobile telephone or analog or digital music player. Such systems also can be used to control any electromechanical system in which excessive motion or temperature is an issue, such as an electric motor.

It will be understood that the foregoing is only illustrative of the principles of the invention, and that the invention can be practiced by other than the described embodiments, which are presented for purposes of illustration and not of limitation, and the present invention is limited only by the claims which follow.

What is claimed is:

1. A method of limiting motion in an electromechanical system, the method comprising:

filtering an input signal using an adaptive filter to yield a predicted motion; and attenuating the input signal by an amount controlled by the predicted motion, including removing components of the input signal at selected frequencies and mixing a portion of the input signal from which the components have been removed with a portion of the input signal from which the components have not been removed.

2. The method of claim 1, wherein the filtering is performed using an adaptive infinite impulse response filter.

3. The method of claim 1 wherein:

the filtering further yields a predicted temperature; and the amount of attenuating is further controlled by the predicted temperature.

4. The method of claim 3 wherein the attenuating comprises clamping the input signal at a predetermined amplitude when the predicted temperature exceeds a threshold.

5. The method of claim 1 wherein:

the electromechanical system is a loudspeaker; and the motion is displacement of a transducer of the loudspeaker.

6. The method of claim 5 wherein the removing components of the input signal at selected frequencies comprises removing components of the signal at a resonant frequency of the loudspeaker.

7. The method of claim 5 wherein the removing components of the input signal at selected frequencies comprises applying a notch filter.

8. The method of claim 7 wherein the applying a notch filter comprises applying a notch filter centered on a resonant frequency of the loudspeaker.

9. The method of claim 1 wherein the mixing is performed according to a combination of more than one mixing function.

10. The method of claim 1 further comprising equalizing the portion of the input signal from which the components have not been removed with the portion of the input signal from which the components have been removed.

11. The method of claim 10 wherein:

the removing components of the input signal at selected frequencies comprises applying a notch filter; and the equalizing comprises phase-adjusting the portion of the input signal from which the components have not been removed to account for phase delay introduced by the notch filter.

12. The method of claim 1 wherein:

the electromechanical system is a motor; and the motion is rotational speed of the motor.

13. Circuitry for limiting motion in an electromechanical system, the circuitry comprising:

an adaptive filter to yield a predicted motion from an input signal; and control circuitry to attenuate the input signal by an amount controlled by the predicted motion, the control circuitry including:

a notch filter to remove components of the loudspeaker input signal at selected frequencies, and a mixer to mix a portion of the input signal that passes through the notch filter with a portion of the input signal that does not pass through the notch filter.

14. The circuitry of claim 13, wherein the adaptive filter is an adaptive infinite impulse response filter.

15. The circuitry of claim 13 wherein:

the adaptive filter is further to yield a predicted temperature; and the control circuitry is further to attenuate the input signal based on the predicted temperature.

16. The circuitry of claim 15 wherein the control circuitry comprises a clamping circuit to clamp the input signal at a predetermined amplitude when the predicted temperature exceeds a threshold.

17. The circuitry of claim 13 wherein:

the electromechanical system is a loudspeaker; and the motion is displacement of a transducer of the loudspeaker.

18. The circuitry of claim 17 wherein the selected frequencies are centered on a resonant frequency of the loudspeaker.

19. The circuitry of claim 13 wherein the mixer is to operate according to a combination of more than one mixing function.

20. The circuitry of claim 13 further comprising a path equalizer to phase-adjust the portion of the input signal that does not pass through the notch filter to match phase delay introduced by the notch filter.

21. The circuitry of claim 13 wherein:

the electromechanical system is a motor; and the motion is rotational speed of the motor.

* * * * *